United States Patent [19]

Garst

[11] 4,203,155

[45] May 13, 1980

[54] APPARATUS AND METHOD FOR CHANGING PRODUCTS ON A CONTINUOUS FIBROUS GLASS PRODUCTION LINE

[75] Inventor: John M. Garst, Granville, Ohio

[73] Assignee: Owens-Corning Fiberglas Corporation, Toledo, Ohio

[21] Appl. No.: 926,591

[22] Filed: Jul. 20, 1978

Related U.S. Application Data

[63] Continuation of Ser. No. 798,510, May 19, 1977, abandoned.

[51] Int. Cl.[2] ..... G06F 15/46; C03B 37/02

[52] U.S. Cl. ..... 364/473; 65/2; 65/160; 65/DIG. 13; 364/105

[58] Field of Search ..... 364/105, 473; 65/2, 65/61-64, 160, 161, DIG. 13

[56] References Cited

U.S. PATENT DOCUMENTS

| | | | |
|---|---|---|---|
| 3,478,808 | 11/1969 | Adams | 364/472 X |
| 3,539,316 | 11/1970 | Trethewey | 65/2 |
| 3,652,243 | 3/1972 | Jensen et al. | 65/2 |
| 3,779,731 | 12/1973 | Pollock et al. | 65/161 X |
| 3,821,624 | 6/1974 | Iadipaolo et al. | 364/117 X |

*Primary Examiner*—Jerry Smith

*Attorney, Agent, or Firm*—Ronald C. Hudgens; Patrick P. Pacella

[57] ABSTRACT

An apparatus and method for setting and maintaining the setpoints of a plurality of product variables for a continuous fibrous glass product on a production line. A computer may be programmed to establish and maintain the setpoints in response to feedback signals representing the actual values of the product variables. In order to minimize lost time and waste material when a job change requires the generation of new setpoints, the computer is programmed to drive the present values of the setpoints to new values for the new product by incrementing each setpoint in sequence until the new values are attained. The initiation of the drive for each setpoint is based on the movement of the product down the line so as to minimize the amount of material sacrificed between the end of the old product and the beginning of the new product.

10 Claims, 7 Drawing Figures

JOB CHANGE FLOW DIAGRAM

APPARATUS AND METHOD FOR CHANGING PRODUCTS ON A CONTINUOUS FIBROUS GLASS PRODUCTION LINE

CROSS-REFERENCE TO RELATED APPLICATION

This application is a continuation of U.S. patent application Ser. No. 798,510 filed on May 19, 1977, now abandoned, and assigned to the same assignee.

BACKGROUND OF THE INVENTION

1. Field Of The Invention

This invention relates generally to production line control systems and in particular to a computer controlled system for establishing and maintaining setpoints for production line controls in a continuous fibrous glass manufacturing process.

2. Description Of The Prior Art.

In a continuous manufacturing process it is essential that the production variables be controlled in order to produce a product having uniform quality. This is especially true in the production of a fibrous structure such as an insulating glass wool mat. Since at least some of the variables are interrelated, it is difficult to manually monitor and adjust the individual setpoints of the various controls. Therefore, it is desirable to have some form of automatic master control.

U.S. Pat. No. 3,539,316 issued to William C. Tretheway on Nov. 10, 1970, and entitled "Method And Apparatus For Manufacturing Fibrous Structures," discloses an apparatus and method utilizing a master controller responsive to a signal representing the rate of deposition of fibers on a collecting surface to interrelate the variables in the production process. The master controller sets the setpoints of various individual controllers along the production line. These setpoints may then be adjusted during the manufacturing process according to a predetermined interrelationship to produce a product having the desired density, width, length, etc.

SUMMARY OF THE INVENTION

The present invention involves a computer controlled system for establishing and maintaining setpoints for production line controls in a continuous manufacturing process wherein it is desired to change the product without stopping the line and with a minimum amount of waste material. In the preferred embodiment, a signal representing the rate of deposition of fibers on a collecting surface may be utilized to interrelate the remaining variables in the process. For example, if the fibers are collected on a conveyor belt, the computer may generate a speed setpoint to the conveyor drive to hold the collecting surface speed at a rate proportional to the rate of deposition sensed.

Furthermore, if an additional component such as a binder is added, the computer may generate a binder feed setpoint to a binder feed control to supply binder in an amount proportional to the rate of fiber deposition sensed. If the binder is to be heated and/or cured, the amount of heat supplied to a curing oven may also be made proportional to the rate of fiber deposition.

To provide a check on the interrelation of the variables, an x-ray sensor may be utilized for measuring the weight per unit area of the fibers and/or binder deposited on the collecting surface and to provide a measurement signal proportional thereto. This measurement signal may be compared with the rate of deposition signal to check the accuracy of the rate of deposition signal. In response to a predetermined difference between the actual and th setpoint signals, a difference signal may be provided for activating an alarm, adjusting the rate of deposition of fibers on the collecting surface, adjusting the setpoint for the binder feed control, and adjusting the setpoint for the curing oven.

While a primary variable such as the rate of deposition of fibers on the collecting surface may be utilized to directly control the remainder of the interrelated variables, the computer also establishes the setpoints for other variables which normally do not require adjustment during this manufacturing process. For example, the width of the product is controlled by the setting of the hood width control and the setting of the trim saws neither of which should require adjustment from the initial setpoint. Another variable which requires little adjustement is the setting of the chopper control which determines the product length.

When a job change is required to produce a new product, the present invention provides an apparatus and method for driving the present setpoints to new values for the new product. The setpoints are driven in increments and in sequence until the new values are attained. The initiation of the drive for each setpoint is determined by the progress of the beginning of the new product down the production line.

Accordingly, it is an object of the present invention to provide a control system for automatically changing a product in a continuous manufacturing process.

Another object of the present invention is to provide a production line control system which minimizes waste material and lost time when changing from one product to another.

A further object of the present invention is to provide a control system which minimizes the differences between actual and desired production parameters in a production line.

It is another object of the present invention to provide an apparatus and method for automatically changing a product in a continuous manufacturing process by driving present setpoint values progressively to new values for the new product in increments and in sequence for a sacrificial section of a new product when a change in product is made.

BRIEF DESCRIPTION OF THE DRAWINGS

Referring to FIGS. 1 and 2, there is shown a part schematic view, part block diagram of a production line for manufacturing fibrous structures such as insulating wool mats, bats or the like. A molten heat softenable material such as glass may be supplied by a forehearth 11 of a glass melting furnace (not shown) to a feeder or bushing structure 12 having a plurality of orifices 13 formed in the bottom thereof to provide streams of molten material for attenuation into fibers. Electrical terminals 14 on each end of the bushing 12 are connected to a bushing power supply and control 15 by a pair of lines 16 and 17. The control 15 is operated to supply current to the terminals 14 which current is translated into Joule effect heating as it passes through the molten material in the bushing 12 in an amount sufficient to maintain the molten material at a desired or predetermined attenuating temperature.

Figures 1, 2:
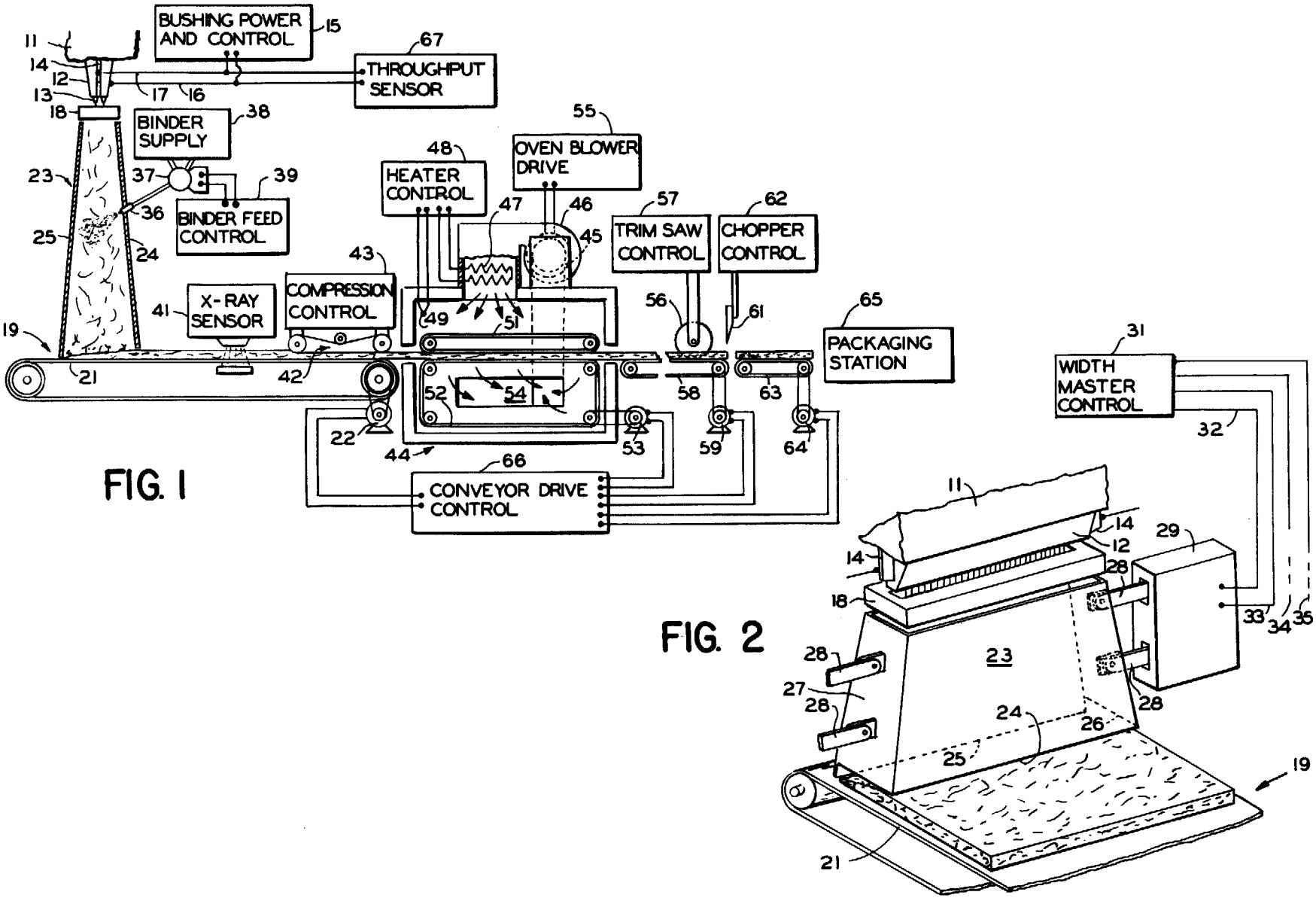
FIG. 1 is a part schematic view, part block diagram view of a production line for manufacturing fibrous structures.
FIG. 2 is a part perspective view, part block diagram of an adjustable hood and associated hood width master control for controlling fiber deposition widths.

There is also shown a blower 18 for directing gaseous blasts of steam or other gases at the streams of molten material issuing from the orifices 13 to attenuate the streams into fibers which are received by a movable collecting surface 19. The surface 19 may comprise an endless conveyor belt 21 mounted on rollers which are driven by a conveyor drive 22. The conveyor belt 21 may be formed from a foraminous material such that a suction device (not shown) may apply suction beneath the conveyor belt to attract the fibers to the upper surface thereof and hold them in their deposited position.

A hood or shield 23 is positioned to confine the deposition of the attenuated fibers over a predetermined area of the moveable collecting surface 19. In FIG. 2 it is shown that the hood 23 comprises a front wall 24, a rear wall 25, and a pair side walls 26 and 27. The side walls 26 and 27 are each connected by one or more arms 28 to a width control mechanism 29. The side walls 26 and 27 may thus be moved inwardly and outwardly to determine the width of deposition of fibers on the collecting surface of the conveyor belt 21. The width control mechanism 29 may comprise a suitable mechanical linkage, for example, a rack and pinion linkage driven by a motor (not shown) which is responsive to a signal from a width master control 31 to set the side walls 26 and 27 at the desired width. The width master control 31 is connected to the width control mechanism 29 by a pair of lines 32 and 33 and is connected to a width control mechanism (not shown) for the side wall 27 by a pair of lines 34 and 35.

Although a bushing and a blower have been shown as the devices for producting the fibers, it is to be understood that other well-known fiber producing devices may also be utilized. For example, the fibers may be formed by the centrifugal process wherein a stream of low-viscosity glass falls on a rotating disc or drum and is flung off the periphery thereof. The glass may also be fed into a rotating spinner having a plurality of holes in its periphery from which the glass is projected into a gas stream.

Each of the above attenuating systems may also include an oscillating distributor or lapper (not shown) located beneath the attenuating mechanism. The magnitude of the swing, or the lapper throw amplitude, may be adjusted by a lapper throw amplitude control (not shown) in proportion to the product width to produce an even distribution of fibers on the moveable collecting surface 19. The center line position or lapper stroke may also be adjusted utilizing a lapper stroke control (not shown).

One or more binder dispensers 36 are disposed to dispense a binder or other additional component onto the fibers being collected on the conveyor belt 21. The binder dispenser 36 may be connected through a flow control device, such as a valve 37, to a binder supply 38. The flow of binder through the valve 37 may be controlled by regulating the size of the valve opening with a binder feed control 39. Although the additional component being supplied to the fibrous mass deposited on the conveyor belt 21 is shown in the drawings as binder, it should be noted that other components may be added to the mass in addition to or instead of a binder. For example, if the mat being formed is to be utilized in filter applications, it may be desirable to intersperse in the mat a collecting compound such as oil which will cause dust or dirt particles in the air to adhere to the otherwise relatively smooth glass fibers which are integrated into a filter mat.

Although FIGS. 1 and 2 show only a single bushing structure 12, bushing power supply and control 5, blower 18 and binder dispenser 36, a plurality of such devices may be provided positioned in series along the moveable collecting surface 19. Typically, the bushings are connected to a common forehearth with each bushing having an associated bushing power supply and control, blower and a binder dispenser. The blowers direct the fibers into a common elongated hood or shield, similar to the hood 23 of FIGS. 1 and 2, extending along the moveable collecting surface to define the collecting area. The plurality of separately controlled bushings provides for a more accurate control of the amount of fibers being deposited and allows for a continuation of the manufacturing process should a bushing and/or any of its associated devices fail.

A device for measuring the actual deposition in terms of weight per unit area may be provided for checking, comparing and sounding an alarm if a tolerance is exceeded or modifying the setting of one or more of the controls involved to return the deposition within the tolerance. An X-ray type sensor 41 may be utilized to direct a beam of X-rays through the mass of fibers in the mat to a measuring device which indicates how much X-radiation is absorbed by the fibers. The X-ray type sensor 41 may be set to measure the quantity of fiber per unit area and/or the quantity of binder or additional component in the mat on the conveyor belt 21.

In the manufacture of a majority of the fibrous structures or mats, compression to some degree is desirable or necessary. Accordingly, a compression roller device 42 is shown which operates to compress the mat on the conveyor belt 21 to the desired thickness. The compression roller device 42 is adjusted by a compression control 43 to the amount of compression desired. Although the compression roller device is shown as being positioned adjacent the X-ray type sensor 41, it may be located inside a curing oven so that the compression occurs during the curing process for the binder.

An oven 44 illustrated for curing the binder or otherwise heat treating the additional component added through the binder dispenser 36. An oven blower motor 45 drives a fan (not shown) to blow a gas, usually air, through an inlet duct 46 into the oven 44 as shown by the arrows. The air may be heated by a resistance heater 47 which is controlled by a heater control 48. The heater control 48 is responsive to a feedback signal from a thermocouple or other heat sensing device 49 disposed within the oven 44 to maintain the air temperature in the oven at a setpoint temperature. The air in the oven 44 is circulated through the mat which is traveling on an oven conveyor belt section having an upper conveyor belt 51 and a lower conveyor belt 52 driven by a conveyor drive 53. The air is pulled through the mat and into an outlet duct 54, as shown by the arrows, by the oven blower motor 45 and fan to be recirculated through the oven 44. An oven blower drive 55 may be utilized to control the amount of air being circulated through the mat.

The amount of air being circulated through the mat may also be controlled by the adjustment of dampers or doors (not shown) which may be located in the inlet duct 46 and/or the outlet duct 54. The air may be passed through the mat in two or three stages of the oven 44 dependent upon the rate of cure desired. The stages are spaced apart along the longitudinal axis of the oven and may be supplied with heated air from a single oven blower and heater into separate inlet ducts at each stage wherein each inlet duct has associated with it separately controlled dampers.

After the mat leaves the oven 44, it may be desirable to trim the edges of the mat either to a predetermined width or to remove rough edges. Accordingly, a trim saw 56 may be utilized to perform the trimming, the width of the trimmed mat and the spend of the saw being controlled by a trim saw control 57. The mat is supported during the trimming operation by a conveyor belt 58 driven by a conveyor drive 59.

After the mat has been trimmed, it may be desirable to cut the mat along the longitudinal axis into one or more strips or lanes. The position of a slitter saw (not shown) may be controlled with reference to the center line of the mat to produce the desired lane widths.

Certain products may be made from the mat, such as building insulation, which require the application of a paper backing to one side of the mat. It is well known to supply paper of a predetermined width from a large roll and to apply adhesive to one side of the paper by drawing the paper over a doctor roller. The adhesive coated side of the paper then be aligned with and pressed against the mat. Although not shown, this operation could be performed after the mat has been trimmed by the trim saw 52 or after the mat has been cut by a slitter saw (not shown) if one is utilized.

A chopper 61 may also be provided to separate or cut the continuous mat into predetermined lengths. The chopper cycle may be controlled by a chopper control 62. The lengths of the mat may then be transported on a conveyor belt 63 driven by a conveyor drive 64 to a packaging station 65 for packing in a suitable manner.

The speeds of the conveyor belts 21, 52, 58 and 63 may be synchronized by controlling the drives 22, 53, 59 and 64 with a conveyor drive control 66. The drive control 66 sets the conveyor speeds to prevent bunching or stretching of the mat as it travels down the production line.

Figure 3:
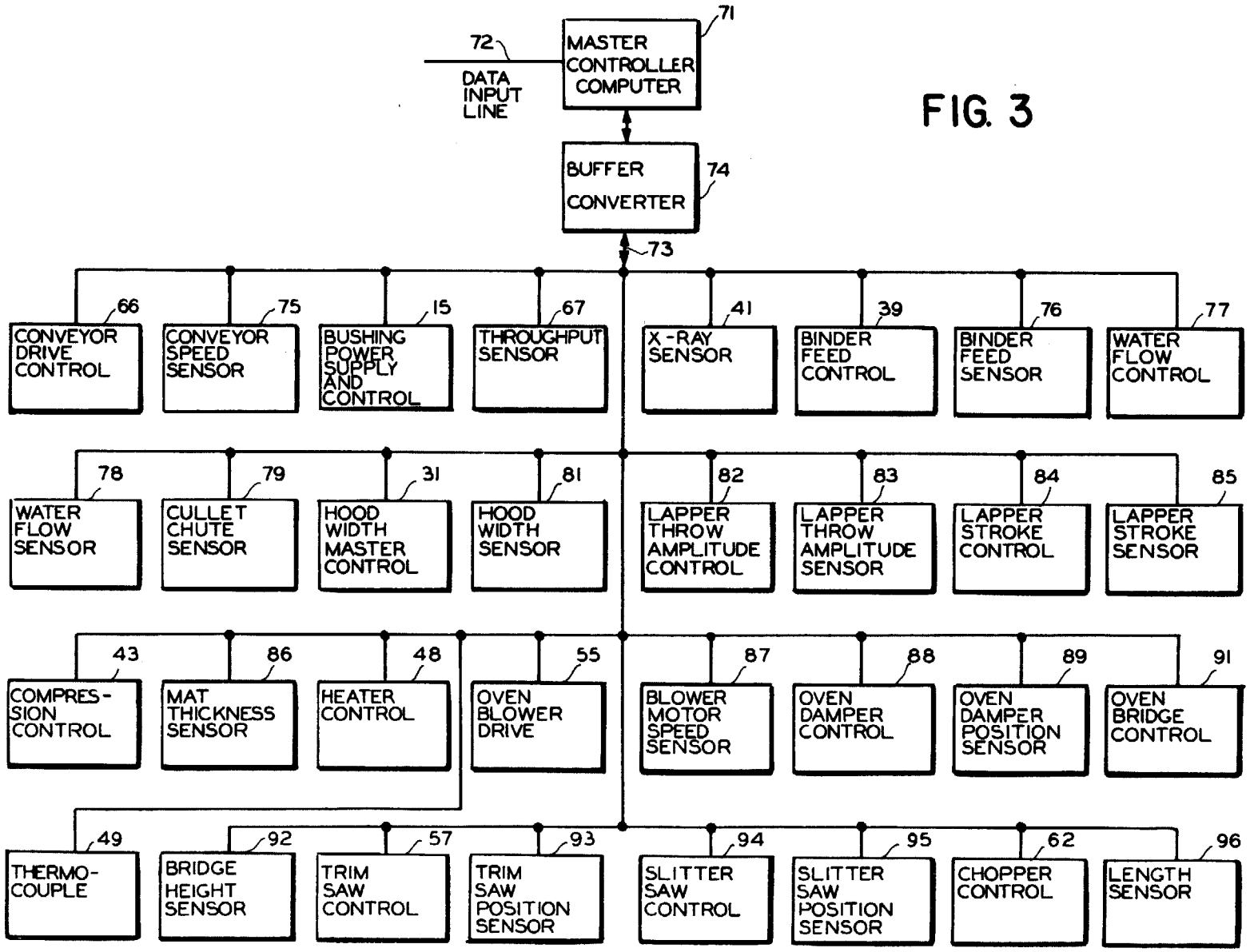
FIG. 3 is a block diagram of the control system according to the present invention for controlling a continuous manufacturing process.

Referring to FIG. 3 there is shown a block diagram of a control system according to the present invention and including the controls shown in FIGS. 1 and 2. A master controller computer 71 receives product information data including the setpoint values for each of the controlled variables in the production line on a data input line 72. The data may be generated on the input line 72 by a punched card or electromagnetic tape reader (not shown) or by manually setting control dials or knobs (not shown). The input data provides information as to the density of the molten glass, the amount of binder to be dispensed, the mat width, the mat length and the conveyor speed. The computer 71 then provides setpoint values for each of the controlled variables in the manufacturing process on an interface line 73 which connects the computer 71 to each of the controls of FIGS. 1 and 2.

Where the same product is continuously manufactured, in some instances there is no adjustment to the setpoints by the computer 71 after they are initially set. For example, the setpoint which is received by the hood width master control 31 will seldom require adjustment if the width control mechanism 29, for the side walls 26 and 27 of the hood 23, is properly calibrated. Similarly, it is unlikely that the compression control 43 or the trim saw control 59 will require adjustment once in operation.

Other variables, however, are interrelated and, if one such variable changes, adjustments must be made to effect a corresponding change in the other interrelated variables. If the molten glass throughput of the bushing structure 12, as measured by a throughput sensing device 67 of FIG. 1, is chosen as the primary variable, then the setpoint of the bushing power control 15 will dictate the setpoint of the binder feed control 39, the X-ray sensor 41, the oven heater control 48, the oven blower drive 55, the chopper control 62 and the conveyor drive control 66. Assuming that there is no change in the primary variable, the manufacturing process will proceed on the basis of the preselected setpoints provided by the computer 71. However, if the primary variable does change during the manufacturing process, it is necessary to effect a corresponding change in the interrelated variables in order to maintain the desired quality of the mats.

When it is desired to change the product being manufactured, it is necessary to change at least some of the setpoints for the product variables. In the prior art this change resulted in a loss of time and product as a line operator reset the setpoints, having either to stop the line or produce a large amount of waste product as the individual setpoints were reset. The present invention provides an apparatus and method for automatically changing a product in a continuous manufacturing process.

DESCRIPTION OF THE PREFERRED EMBODIMENT

In accordance with the preferred embodiment of the present inventor, a product change is accomplished with a minimum of lost production time by resetting the required setpoints as the continuous product moves down the production line to define a sacrificial portion of the product equal in length to the speed of the line times the length of time required to reset the setpoint having the longest reset time. The individual setpoints are sequentially reset when the sacrificial portion of the continuous product is adjacent the corresponding means for processing the material as the material moves along the production line.

Typically, the master controller computer 71 of FIG. 3 may be a Model 1800 digital computer manufactured by International Business Machines, Armonk, N.Y. 10604. The input data is entered on the input line 72 each time it is desired to change the product or the data may be entered once and stored in the memory of the computer 71 until it is needed for a product change. If the data is stored, only the product identification code need be entered to change the product setpoints. Typically, most controllers such as the bushing power control 15 respond to analog signals. Therefore, the digital output signals representing setpoints must be changed to analog signals by a digital-to-analog converter in a buffer-converter 74 before being placed on the interface line 73. Similarly, the buffer-converter must also include an analog-to-digital converter to change the analog signals from the controllers to digital signals for use in the computer 71. The interface line 73 and the buffer converter 74 are bidirectional devices which pass signals between the computer 71 and the various controls and sensors.

There are two methods of loop control which may be utilized with the control system shown in FIG. 3. In the first method, the computer 71 generates the setpoint signals to the individual controls but does not change these setpoints unless there is data on the input line 72 requesting the change of a setpoint for a specific product variable or requesting a job change. Each control then has a feedback control loop from a specific sensor for changing the setpoint received from the computer 71 in accordance with the conditions on the production line. This method of control is open loop for the line and closed loop for each product variable.

In the second method, the computer receives the signals representing conditions along the line from the sensors and, in response thereto, adjusts the setpoints being generated. Therefore, the line is closed loop controlled end-to-end to provide a more uniform and timely control of product flow. The computer 71 can sense a changed condition at one point on the line and change a setpoint at a control further down the line to anticipate the effect of the changed condition.

For a given product and its associated product variables, there is an optimum line speed based on the maximum rate of pulling in a rotary process or on the maximum rate of production of fibers deposited on a conveyor as shown in FIGS. 1 and 2. The computer 71 establishes setpoints for each of the controls shown in FIG. 3 according to the product information for the product being manufactured. Speed setpoints are sent over the interface line 73 to the conveyor drive control 66 which in response thereto controls the speeds of the conveyor belts 21, 52, 58 and 63 with the conveyor drives 22, 53, 59 and 64. A conveyor speed sensor 75 (not shown in FIG. 1) senses the actual speeds of each of the conveyor belts and generates feedback speed signals to the computer 71 which adjusts the speed setpoints accordingly.

The rate of production of fibers deposited on the conveyor belt is determined by the capacity of each bushing structure to produce fibers and the number of bushing structures supplying fibers to the production line. The computer 71 sends a fiber production rate setpoint signal to the bushing power supply and control 15, and, since the power supplied to the bushing structure is proportional to the flow rate, the throughput sensor 67 generates a rate feedback signal in response to the power applied to the bushing. The computer 71 then adjusts the rate setpoint signals in accordance with the feedback signal. The overall rate of production of fibers may be sensed by the X-ray sensor 41 which generates a feedback signal to the computer 71. The computer then utilizes the overall flow rate and individual bushing flow rates to adjust the setpoints for the individual bushing power supplies and controls.

The amount of binder supplied to the fibers being deposited on the conveyor belt is determined by the percentage of binder required in the mat. The computer 71 sends a binder feed setpoint signal to the binder feed control 39 which sets the opening of the valve 37 of FIG. 1. A binder feed sensor 76 can be utilized to sense the amount of binder being supplied and send a binder feed feedback signal to the computer which in response thereto adjusts the binder feed setpoint signal.

The binder may be diluted with water as required in the production of certain products. This water can be supplied (not shown in FIG. 1) in a manner similar to the binder with a flow control 77 and a flow sensor 78. The computer 71 sends a water flow setpoint signal to the water flow control 77 and adjusts that setpoint signal in accordance with a water flow feedback signal generated by the water flow sensor 78.

The line speed, binder flow and water flow may also be adjusted according to the number of cullet chutes operating as represented by a feedback signal generated by a cullet chute sensor 79 (not shown in FIG. 1). When a bushing is to be removed from the line, a cullet chute is inserted to divert the streams of molten material from the conveyor belt 21. Therefore the associated binder feed control 39 and water feed control 77 must be shut off by the computer 71 and the line speed must be adjusted to the lower fiber deposition rate. This speed adjustment can be accomplished by subtracting a bias from the speed setpoint proportional to a ratio of the inactive bushings to the total number of bushings where new setpoint - old setpoint - [(old setpoint) (inactive bushings)/(total bushings)]. The cullet chutes may also be inserted to divert all the streams of molten material from the conveyor belt 21 to create a void between the end of one product and the beginning of the next product.

The computer 71 also sends a hood width setpoint signal to the controller 31 to position the hood sidewalls for the width of the mat. A hood width sensor 81 (not shown in FIG. 1) generates a feedback signal to the computer 71 which responds to the feedback signal by adjusting the hood width setpoint signal. Any adjustment of the hood width will also require an adjustment to the lapper throw amplitude. A lapper throw amplitude control 82 (not shown in FIG. 1) receives an amplitude setpoint signal from the computer which setpoint signal is adjusted according to an amplitude feedback signal generated by a lapper throw amplitude sensor 83 (not shown in FIG. 1). A lapper stroke control 84 (not shown in FIG. 1) receives a stroke setpoint signal from the computer 71 which setpoint signal is adjusted according to a stroke feedback signal generated by a lapper stroke sensor 85 (not shown in FIG. 1).

The compression control 43 may receive a compression control setpoint signal from the computer 71 on the interface line 73. A mat thickness sensor 86 (not shown in FIG. 1) generates a feedback signal to the computer 71 which adjusts the compression control setpoint signal accordingly to control the thickness of the mat.

The curing of the binder in the mat is controlled by the temperature and amount of air circulating through the oven for a given line speed and percent binder. The computer 71 sends a temperature setpoint signal to the heater control 48 which heats the air circulating through the oven 44. The thermocouple 49 of FIG. 1 may be connected to send a temperature feedback signal to the computer 71 which adjusts the temperature setpoint signal. The computer 71 also sends a blower drive setpoint signal to the oven blower drive 55 to control the oven blower motor speed. An oven blower motor speed sensor 87 (not shown in FIG. 1) sends a speed feedback signal to the computer 71 which adjusts the slower drive setpoint signal. The computer also generates an oven damper control setpoint signal to an oven damper control 88 (not shown in FIG. 1) which adjusts dampers located in the inlet duct 46 and/or the outlet duct 54 of the oven 44. An oven damper position sensor 89 (not shown in FIG. 1) sends a position feedback signal to the computer 71 which adjusts the oven damper control setpoint signal accordingly. The oven 44 may also include an oven bridge (not shown in FIG. 1) at the entrance thereto to size the mat to the correct thickness as determined by an oven bridge control 91 (not shown in FIG. 1). The computer 71 sends a height setpoint signal to the bridge control 91. A bridge height sensor 92 (not shown in FIG. 1) sends a height feedback signal to the computer 71 which adjusts the height setpoint signal accordingly.

After the mat exits the oven 44, it is trimmed, slit and cut to length. The computer 71 sends a trim saw position setpoint signal to the trim saw control 57 to determine the trimmed width of the mat. A trim saw position sensor 93 (not shown in FIG. 1) sends a position feedback signal to the computer 71 which adjusts the trim saw position setpoint signal accordingly. Next the mat may be slit into two or more strips by a slitter saw (not shown). The computer 71 sends a slitter saw position setpoint signal to a slitter saw control 94 (not shown in FIG. 1) and a slitter saw position sensor 95 (not shown in FIG. 1) sends a position feedback signal to the computer 71. The c computer 71 adjusts the position setpoint signal in response to the feedback signal.

The chopper control 62 receives a length setpoint signal from the computer 71. A length sensor 96 (not shown in FIG. 1) sends a length feedback signal to the computer 71 which adjusts the length setpoint signal accordingly.

The connection of the computer 71 with the various product variable controls and their associated sensors through the buffer-converter 74 and interface line 73 provides the means for sequentially and progressively adjusting the controls along the line at a rate dependent upon the line speed to effect a change in the product being manufactured. The closed loop approach to the production line provides for a more uniform and timely product flow and a decrease in lost time and material when a job change is made.

As a setpoint is being changed to effect a product change, that portion of the product moving past the processing means associated with the setpoint will be sacrificed as waste material since its properties reflect the transition of the setpoint. The present invention sequentially changes the setpoints of the various processing means during the time the sacrificial portion is adjacent those processing means as the product moves down the production line in order to minimize lost production time and the length of the sacrificial portion. If the cullet chutes have been inserted to create a void during the transition, the length of the void will correspond to the length of the sacrificial portion created when fibers are being deposited on the conveyor belt 21.

Figure 4:
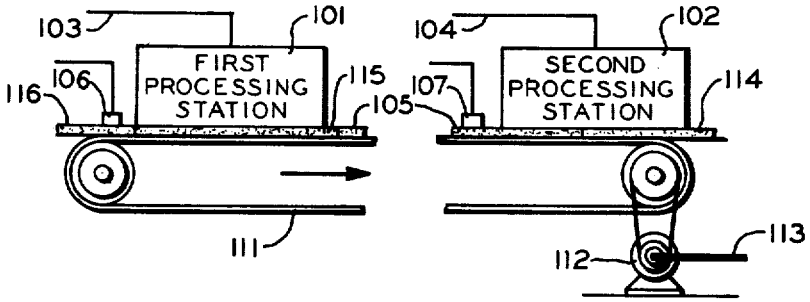
FIG. 4 is a part schematic, part block diagram view of a portion of a production line including two processing stations for processing continuous fibrous products according to the present invention.

There is shown in FIG. 4 a part schematic, part block diagram of a portion of a production line for processing continuous fibrous glass products. The fibrous glass generated by the elements 11 through 18 of FIG. 1 are processed into continuous products in response to a plurality of control signals. A first processing station 101 and a second processing station 102 are spaced apart along the path of travel of the continuous products and receive control signals on the lines 103 and 104 respectively. Although not shown, the control lines 103 and 104 can be connected to any two of the control means shown in FIG. 3 which controls are responsive to setpoint signals representing processing variables for generating the control signals.

There is also shown means for defining the advance of a sacrificial production increment 105 through each of the first 101 and second 102 processing stations, the sacrificial production increment including lost production of the continuous products. The advance defining means can include a pair of sensors 106 and 107 positioned upstream of the processing stations 101 and 102 respectively. The sensors can be x-ray devices for detecting a radioactive dye marking the sacrificial production increment 105 or any other suitable means for detecting the advance of the increment through the processing stations. A pair of output signal lines 108 and 109 from the sensors 106 and 107 respectively would then be attached to the interface line 73 of FIG. 3 to provide the information on the advance of the increment.

An alternate form of advance defining means includes a calculation by the master controller computer 71 of FIG. 3 as to where the sacrificial production increment is along the production line. The position of the increment is determined by the speed of the conveyor and the elapsed time from the first change made. Therefore, in FIG. 4, a conveyor belt 111 is driven at a predetermined speed by a conveyor drive 112. The speed of the belt and thus the speed of the sacrificial production increment is directly proportional to the speed of the drive such that a speed sensing device, as for example a tachometer which can be the conveyor speed sensor 75 of FIG. 3, generates a speed signal on a line 113 to the interface line 73. The computer 71 has an internal clock for maintaining a count of elapsed time from the time at which the change in the setpoint for the first processing station 101 was initiated. The computer can then calculate when the leading edge of the sacrificial production increment 105 will reach the second processing station 102 from the speed of the conveyor belt 111 and the distance between the two processing stations.

The system according to the present invention also includes means for generating a product change request such as the input line 72 to the computer 71. The computer generates the setpoint signals and is responsive to the advance defining means and the product change request for changing the value of at least one of the setpoint signals associated with each of the first 101 and second 102 processing stations during the times that the sacrificial production increment is being processed by the first and second processing stations respectively. Thus, if a first product 114 is being processed and a product change request is generated, at least one of the setpoints for the first processing station 101 will be changed to change the product and reduce lost production time whereby the sacrificial increment 105 is created. When the sacrificial production increment reaches the second processing station, at least one of the setpoints for the station 102 is changed during the time the increment is being processed. Thus, along the production line there will be the first continuous fibrous product 114, the sacrificial production increment 105, a second continuous fibrous product 115 being processed by the station 101 and fibrous glass 116 to be processed into the second fibrous product.

Figure 5:
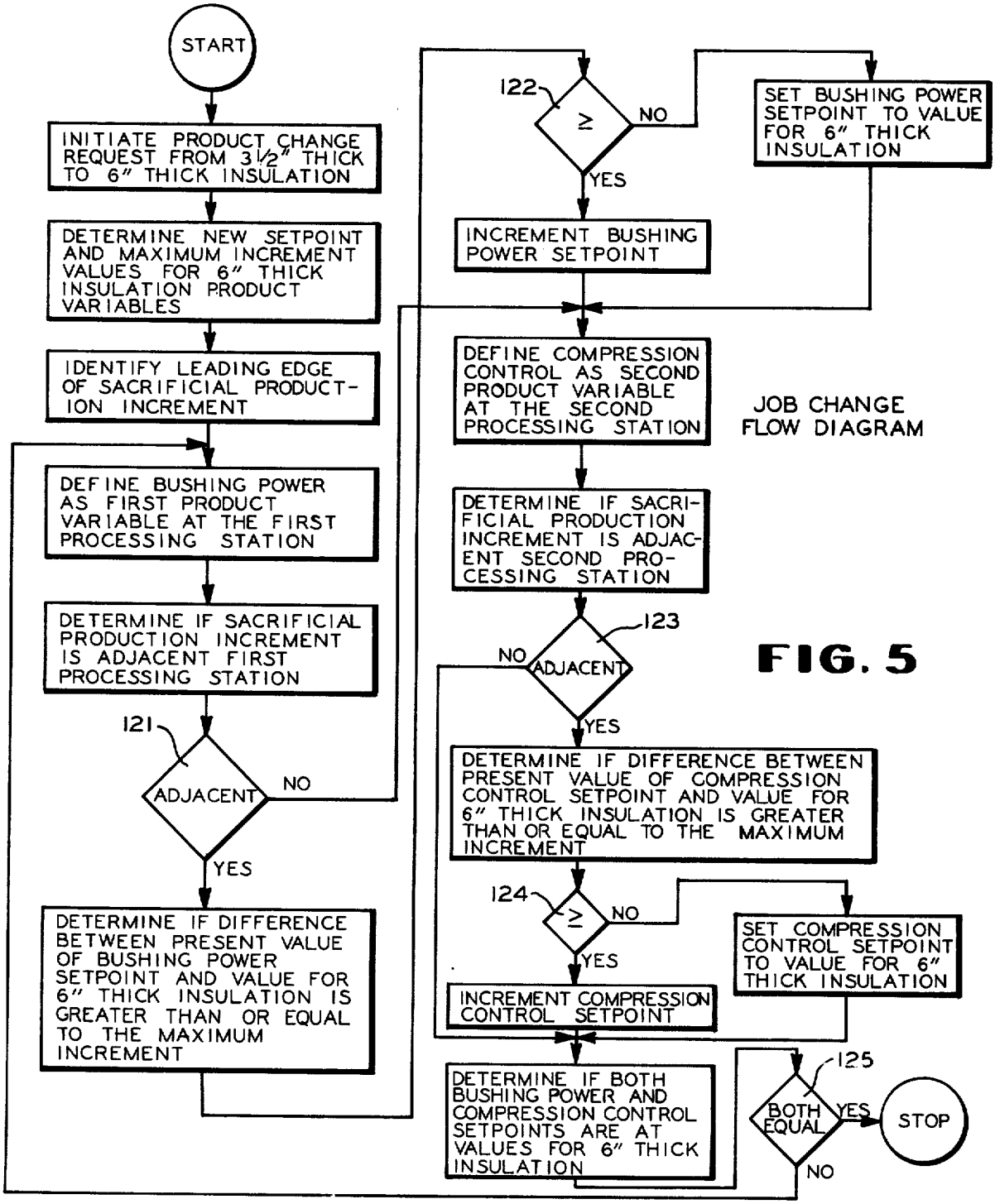
FIGS. 5, 6 and 7 are a flow diagram of a method for controlling a continuous manufacturing process and for automatically changing a product manufactured by said process wherein the diagram of FIG. 6 is continued on FIG. 7 at point L and is returned to FIG. 6 at point M.

There is shown in FIG. 5 a flow diagram for a typical job change which can be related to the portion of a production line shown in FIG. 4. The flow diagram begins at the circle labeled "START". A product change request is initiated where, for example, it is desired to change from the production of 3½" thick insulation to 6" thick insulation. Next, the new setpoint and maximum increment values for the 6" thick insulation product variables must be determined. These values can be supplied to the computer 71 of FIG. 3 on the data input line 72 at the time of the product change request or can be stored in the computer memory to be called up in response to a product change request. After the maximum increment and setpoint values have been determined, the leading edge of the sacrificial production increment must be identified. As discussed in connection with FIG. 4, the leading edge of the sacrificial production increment is adjacent the trailing edge of the first product 114 and its advance can be defined by detectors 106 and 107 or can be calculated by the computer from a speed signal generated by the conveyor speed sensor 75 of FIG. 3 on the line 113.

Now the setpoint signals must be incrementally changed to the values for 6" thick insulation. For the purposes of our example, we will assume that only two product variables are involved, the bushing power and the compression control. However, as discussed with respect to FIG. 1, more than one bushing can be utilized to generate the glass fibers and other product variables could interact with the bushing power and compression control to require additional setpoints to be changed. Such interaction would not change the method as disclosed, but would only increase the number of steps required in the program. In FIG. 5, the bushing power is defined as the first product variable at the first processing station, the station 101 of FIG. 4. A check is made to determine if the sacrificial production increment is adjacent the first processing station. If the increment is not adjacent, the flow diagram branches from a decision point "ADJACENT" 121 at "NO" to the portion relating to the second product variable. If the increment is adjacent, the flow diagram branches at "YES" and a determination is made as to whether the difference between the present value of the bushing power setpoint and the value for 6" thick insulation is greater than or equal to the maximum increment. If the difference is greater than or equal to the maximum increment, the flow diagram branches from a decision point "≧" 122 at "YES" and the bushing power setpoint is incremented by the amount of the maximum increment. If the difference is not greater than or equal to the maximum increment, the flow diagram branches at "NO" and the bushing power setpoint is set to the value for 6" thick insulation to correct for a situation where the difference between the setpoints for 3½" and 6" thick insulation is not equal to a whole number of maximum increments.

Both branches from the bushing power difference decision point 122 and the "NO" branch from the "ADJACENT" decision point 121 lead to the portion of the flow diagram relating to the second product variable. The compression control is defined as the second product variable at the second processing station, the station 102 of FIG. 4. A check is made to determine if the sacrificial production increment is adjacent the second procession station. If the increment is not adjacent, the flow diagram branches from a decision point "ADJACENT" 123 at "NO" to the end portion of the program. If the increment is adjacent, the flow diagram branches at "YES" and a determination is made as to whether the difference between the present value of the compression control setpoint and the value for 6" thick insulation is greater than or equal to the maximum increment. If the difference is greater than or equal to the maximum increment, the flow diagram branches from a decision point "≧" 124 at "YES" and the compression control setpoint is incremented by the amount of the maximum increment. If the difference is not greater than or equal to the maximum increment, the flow diagram branches at "NO" and the compression control setpoint is set to the value for 6" thick insulation to correct for a situation where the difference between the setpoints for 3-3½" and 6" thick insulation is not equal to a whole number of maximum increments.

Both branches from the compression control difference decision point 124 and the "NO" branch from the "ADJACENT" decision point 123 lead to the end portion of the flow diagram. At the end of the flow diagram, a determination is made as to whether both the bushing power and the compression control setpoints are at values for 6" thick insulation. If they are both equal, the flow diagram branches from a decision point "BOTH EQUAL" 125 at "YES" to the circle labeled "STOP" and the job change is complete. If both are not equal, the program branches at "NO" to return to the portion of the flow diagram relating to the first product variable. The computer will continue to loop through the first and second product variable portions of the flow diagram until both of the setpoints have been driven to their new values. Depending upon the spacing of the processing stations, the speed of the production line and the time required to drive the setpoints, the incrementing of the two setpoints could overlap for a period of time or be separated by a period of time during which neither setpoint is being driven.

Figure 6:
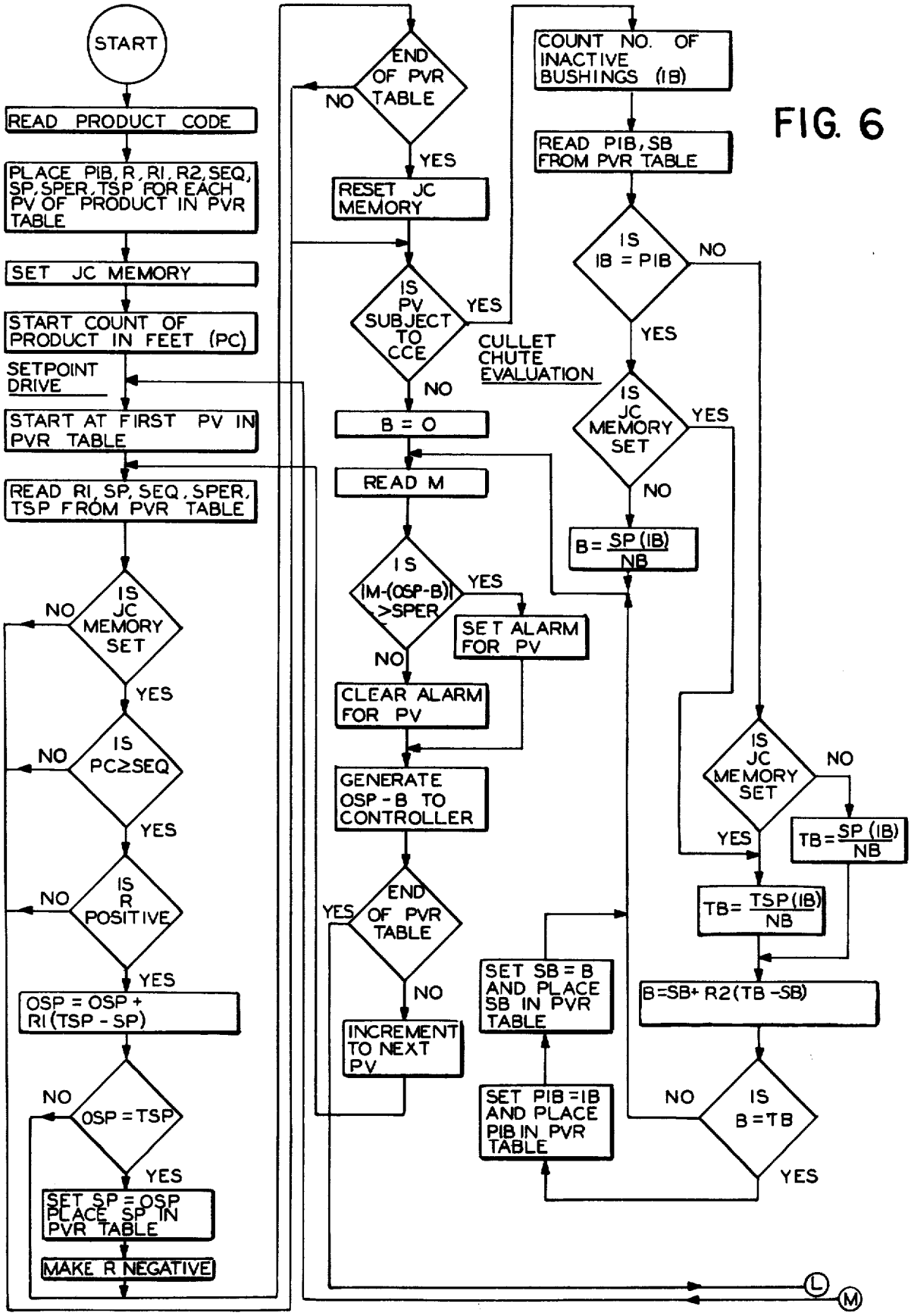
Figure 7:
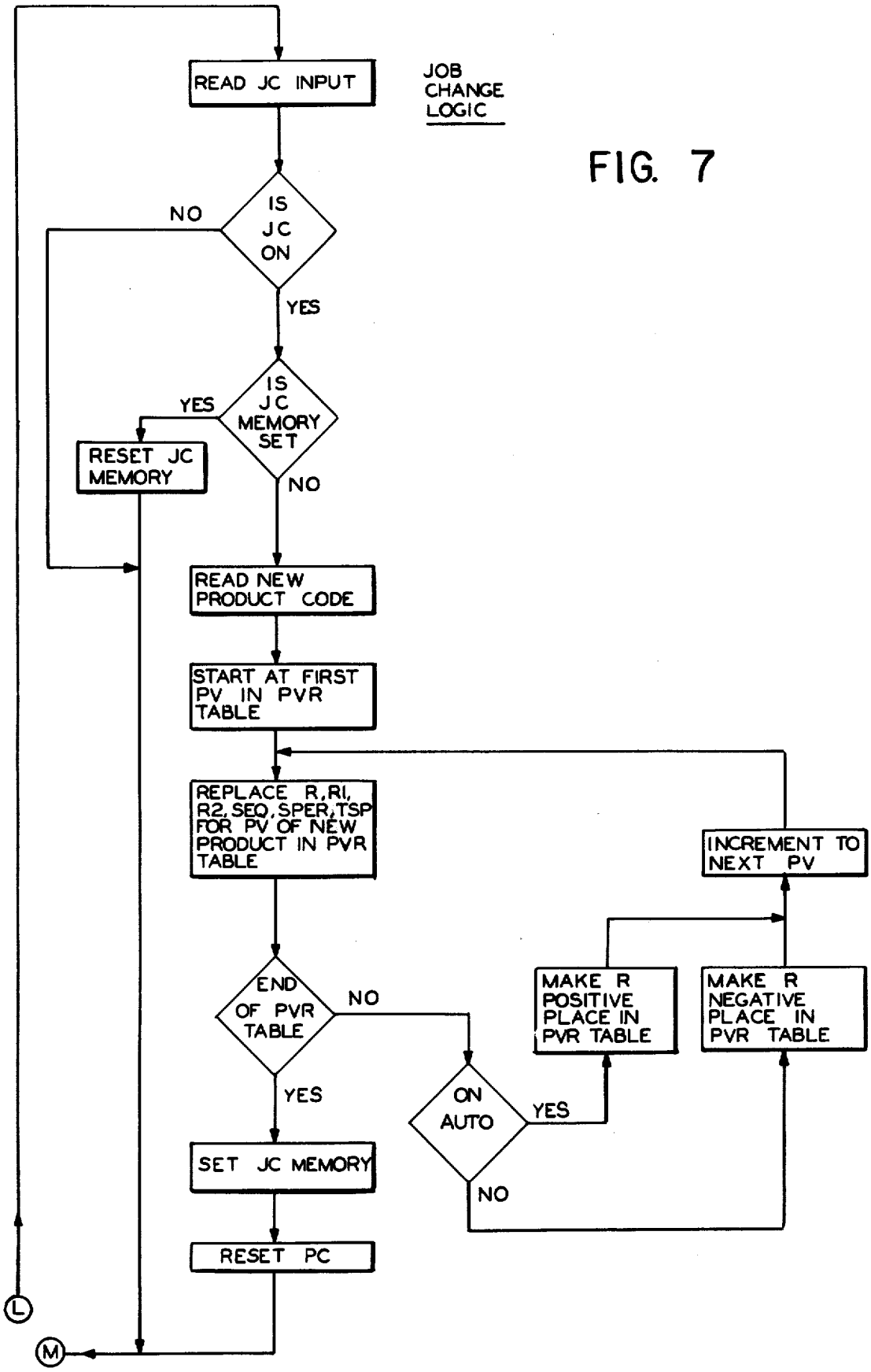

Referring to FIGS. 6 and 7, there is shown a more detailed flow diagram of a computer program for use with the computer 71 for effecting a job change on a production line similar to the production line shown in FIG. 1. Table I below lists a definition for each of the symbols utilized in FIGS. 6 and 7.

TABLE I

B—bias for setpoints responsive to fiber deposition rate.
CCE—cullet chute evaluation.
IB—number of bushings presently inactive.
JC—job change.
M—measured value of product variable.
NB—total number of bushings.
OSP—Output setpoint.
PC—product count in feet.
PIB—number of bushings previously inactive.
PV—product variable.
PVR—product variable record.
R—rate indicator.
R1—setpoint rate of change.
R2—bias rate of change.
SB—steady state bias of setpoints.
SEQ—point at which the setpoint of the product variable is to be driven.
SP—steady state setpoint for product variable.
SPER—error tolerance for product variable value.
TB—target bias.
TSP—target setpoint.

The flow diagram begins at the circle labeled "START" on FIG. 6. The computer 71 reads a product code which is supplied on the data input line 72. The product code directs the computer 71 to its memory to read the number of bushings previously active (PIB), the rate indicator (R), the setpoint rate of change (RI), the bias rate of change (R2), the point at which the setpoint of the product variable is to be driven (SEQ), the setpoint (SP), the error tolerance for the product variable value (SPER), and the target setpoint (TSP) for each product variable (PV) of the product and places these values in the product variable record (PVR) table for use in controlling the production line. Next the job change (JC) memory is set to indicate that a job change is in progress and a count (PC) of the feet of product being manufactured is started.

A main loop of the computer program is utilized to drive each setpoint signal to a new value or target setpoint (TSP) when a job change is in progress, to provide a bias to those setpoint signals which are related to the cullet chute evaluation, and to generate the setpoint signals to the respective controllers. When a job change is to take place, the drive for a setpoint is initiated when a sacrificial portion of the product or a void is adjacent the processing means for the product variable involved. Therefore, a group of setpoints for a group of processing means which are closely spaced along the production line may be driven to new values at substantially the same time while one or more other setpoints for more widely spaced processing means await the arrival of the sacrificial portion or void before being driven in sequence at substantially different times. Since the setpoints are driven during the time the sacrificial portion or void is adjacent the processing means, the length of the sacrificial portion or void will be determined by the speed of the conveyor and the longest time required to change a setpoint. The arrival of the sacrificial portion or void adjacent the various processing means may be detected by sensors or may be calculated by the computer 71 from the elapsed time as discussed above.

The loop begins with the setpoint drive portion of the program at the first product variable (PV) listed in the product variable record (PVR) table wherein the R1, SP, SEQ, SPER and TSP values are read for that product variable. A check is made to see if the job change (JC) memory is set. If a job change (JC) is not in progress, then the program branches at "NO" and goes to the cullet chute evaluation portion of the program. If a job change (JC) is in progress, evidenced by a setting of the job change (JC) memory, the program will branch at "YES" where a check is made to see if the product count (PC) equals or exceeds the point at which the setpoint is to be driven (SEQ). If PC is less than SEQ, the setpoint for that product variable cannot as yet be driven and the program will branch at "NO" to the cullet chute evaluation. If enough feet of product have been produced, the conditions will be fulfilled and the program will branch at "YES" where a check is made to see if the rate indicator (R) is positive. The (R) for each product variable is made positive in the memory so that the program will branch at "YES" during the time that setpoint is being driven. When the setpoint has been driven to the target setpoint (TSP) value, (R) is made negative and the program will branch at "NO" to the cullet chute evaluation.

During the time that a setpoint is being driven, its value will be changed by the increment R1 (TSP-SP) where the target setpoint (TSP) is the new value of the setpoint for the product variable and setpoint (SP) is the previous value of the product variable. When the production line is first started, SP will be equal to zero and thereafter will be equal to the steady state value of the setpoint for the product variable. The output setpoint (OSP) is set equal to its previous value plus the increment R1 (TSP-SP) each time the product variable is selected from the product variable record (PVR) table which occurs once each time the program cycles through the PVR table. The setpoint rate of change R1 stored in the PVR table has a value corresponding to units of the associated product variable per increment or cycle of the PVR table. The amount of the change (TSP−SP) divided by the rate of change R1 determines the number of cycles of the PVR table required to change from SP to TSP. R1 is then set equal to the reciprocal of the next highest integer number of cycles and multiplied by (TSP−SP) to determine the value of the increment. As OSP is driven, the program will branch at "NO" from the OSP-TSP check to the "END OF PVR TABLE" check. When OSP has been incremented enough to equal TSP, then the program branches at "YES," the setpoint (SP) in the product variable record (PVR) table is set equal to the output setpoint (OSP) and the rate indicator (R) is made negative to indicate that the setpoint is not to be driven.

Both the "NO" and "YES" branches from the "OSP-TSP" check lead to the "END OF PVR TABLE" check. If it is not the last product variable (PV), then the program branches at "NO" to the cullet chute evaluation. If it is the last product variable (PV), then the program branches at "YES" to reset the job change (JC) memory to indicate the end of the setpoint driving for the new product before going to the cullet chute evaluation.

Since the main loop selects each product variable in order from the product variable record (PVR) table, the setpoints will be driven in sequence to the new values of the target setpoints by increments, one increment for each complete cycle through the PVR table. For these setpoints to be driven, the SEQ value for each determines when the driving of the setpoint is to begin in relation to the movement of the product down the line so that when the beginning of the new product reaches the control point for that product variable the new setpoint value has also been reached. Thus, the initiation of the driving of the setpoints progresses down the production line with the beginning of the new product such that the setpoints of controls spaced near to one another are being driven at the same time.

As was previously discussed, the bushing 12 of FIG. 1 can represent several bushings which are providing streams of glass for attenuation into fibers. Since it is difficult and time consuming to restart the flow of molten glass through a bushing once it has been stopped, typically a cullet chute (not shown) will be inserted between the bushing 12 and the hood 23 to divert the glass from the production line. When such an insertion takes place either to reduce the amount of fibers being produced or to remove a bushing in need of service or when a cullet chute is removed to increase the production of fibers, certain related setpoints must be adjusted to compensate. For example, the line speed must be increased if a cullet chute is removed and decreased if a cullet chute is inserted to maintain the fiber deposition rate.

At the cullet chute evaluation portion of the first loop, a first check "IS PV SUBJECT TO CCE" is made to determine if the product variable is subject to the cullet chute evaluation due to a change in the number of effective cullet chutes. If the product variable (PV) is not subject to the cullet chute evaluation (CCE), the program branches at "NO" and the bias (B) for the setpoint is set equal to zero. If the product variable is subject to the cullet chute evaluation (CCE), then the program branches at "YES" where a count of the inactive bushings (IB) is made. The number of bushings which previously were inactive (PIB) is read from the computer memory and a check is made to see if "IB—PIB". If "IB—PIB", then the program branches at "YES" and a check is made at a decision point "IS JC MEMORY SET" to see if the job change (JC) memory is set. If the job change is not in progress, the program will branch at "NO" and the bias (B) will be set equal to the setpoint (SP) times the number of inactive bushings (IB) divided by the total number of bushings (B), B—SP(IB)/NB.

If a job change is in progress, both the "NO" and "YES" branches of "IS IB—PIB" lead through the "YES" branch of an "IS JC MEMORY SET" decision point set the target bias (TB) equal to the target setpoint (TSP) times the number of inactive bushings (IB) divided by the total number of bushings (NB), TB—TSP(IB)/NB. The target bias is the new bias to which the old bias must be driven when the number of inactive bushings changes. If "IS IB—PIB" is "NO" and "IS JC MEMORY SET" is also "NO", then the target bias (TB) is equal to the setpoint (SP) times the number of inactive bushings (IB) divided by the total number of bushings (NB), TB—SP(IB)/NB.

After the target bias has been calculated, the bias (B) is driven by adding an increment equal to the bias rate of change (R2) times the difference between the target bias (TB) and the steady state bias (SB). The bias rate of change R2 stored in the PVR table has a value corresponding to units of the associated bias per increment of the cullet chute evaluation CCE. The amount of change (TB—SB) divided by the rate of change R2 determines the number of cycles of the CCE required to change from SB to TB. R2 is then set equal to the reciprocal of the next highest integer number of cycles and multiplied by (TB—SB) to determine the value of the increment. "IS B—TB" is checked and, if the bias (B) is being driven, the program will branch at "NO." If the bias (B) is no longer driven, the program will branch at "YES," PIB will be set equal to IB and stored, and SB will be set equal to B and stored. The "B—SP(IB)/NB" step, the "NO" branch of the "IS B—TB" check, and the "SET SB—B AND PLACE SB IN PVR TABLE" step all return to the main loop at the "B—O" step where the measured value (M) of the product variable is read from the feedback signal generated by one of the sensors shown in FIG. 3.

A check is made to see if the difference between the measured value (M) and the output setpoint (OSP) minus the bias (B) is greater than the predetermined error tolerance (SPER), "IS $|M-(OSP-B)|>SPER$". If the error tolerance is not exceeded, the program will branch at "NO" and an alarm for the product variable (PV) is cleared. If the error tolerance is exceeded, the alarm is set to alert the supervisory personnel that a malfunction has occurred. The output setpoint (OSP) minus the bias (B) is then generated to the associated controller as the setpoint for the product variable. A check is made to see if the present product variable is the last one in the product variable record (PVR) table. If it is not, the program branches at "NO" and is incremented to the next product variable before returning to the beginning of the main loop. If it is the last product variable, the program branches at "YES" to the job change logic portion of the flow diagram shown in FIG. 7 and connected to FIG. 6 at point "L".

A first step in the job change logic is to read the job change (JC) input. The job change input is a signal from the computer which may be generated by the input of a new product code to start a job change or by the input of a stop signal requesting that a job change in progress be stopped. If the job change (JC) signal is not on, the program returns to the beginning of the main loop from the "NO" branch to FIG. 6 at point "M". If the job change (JC) signal is on, the program branches at "YES" to a check to see if a job change is in progress. If a job change is in progress, the program branches at "YES" from "IS JC MEMORY SET" to reset the job change (JC) memory thereby stopping the job change and returning the program to the beginning of the main loop of FIG. 6 at point "M". If the job change (JC) is not in progress, the program will branch at "NO" from "IS JC MEMORY SET" to read the new product code and start a job change.

The start of the job change begins at the first product variable (PV) in the product variable record (PVR) table for the new product and replaces R, R1, R2, SEQ, SPER, and TSP in the PVR table with new values from the computer memory. A check is made for the last product variable and when it is reached, the program branches at "YES" from "END OF PVR TABLE" to set the job change (JC) memory, reset the product count (PC) and return to the beginning of the main loop of FIG. 6 at point "M" to drive the setpoints to the values of the new target setpoints.

Each product variable before the last product variable will cause the program to branch at "NO" from "END OF PVR TABLE" to a check to see if the setpoint for that product variable is being automatically controlled. If that setpoint is not being automatically controlled, the program will branch at "NO" from "ON AUTO" to make the rate indicator (R) negative to indicate that the setpoint of the product variable is not to be driven. If the setpoint is automatically controlled, the program will branch at "YES" from "ON AUTO" to make the rate indicator (R) positive to indicate that the setpoint is to be driven. After the rate indicator is made positive or negative, the program increments to the next product variable and returns to the loop to update the product variable records (PVR) of the next product variable.

Therefore, the flow diagram of FIGS. 6 and 7 shows a program for driving the setpoints of product variables for a product presently being manufactured to target setpoints representing new values of the product variables for a new product in order to automatically change products on a continuous production line. The setpoints are driven sequentially in increments toward the new values with the initiation of the drive of each setpoint related to the movement of the job change down the production line to reduce the loss of time and to reduce the waste material during a job change.

Those setpoints which are responsive to the number of active bushings are modified by subtracting a bias which is the value of the setpoint times the number of inactive bushings divided by total number of bushings. The bias is also driven to a new value when the number of inactive bushings changes.

In summary, the present invention relates to an apparatus and method for automatically effecting a job change in a continuous production line by driving the product variable setpoints to new values through sequentially incrementing the setpoints according to a predetermined rate. The initiation of the drive of each setpoint is correlated with the movement of the product down the production line to effect a minimum of lost time and material. Although shown in the preferred embodiment as an apparatus and method for changing a job on a glass fiber mat production line, the present invention may be utilized in the manufacture of any continuous product where it is desired to change the product.

In accordance with the provisions of the patent statutes, I have explained the principle and mode of operation of my invention and have illustrated and described what I now consider to represent its best embodiment. However, I desire to have it understood that the invention may be practiced otherwise than as specifically illustrated and described without departing from its spirit or scope.

What is claimed is:

1. A system for controlling the production of each one of a plurality of continuous fibrous glass products, comprising:

a source of fibrous glass for the continuous products;

means for processing said fibrous glass into the continuous products in response to a plurality of control signals, said processing means including at least a first and a second processing station spaced apart along the path of travel of the continuous products;

means for defining the advance of a sacrificial production increment through each of said first and second processing stations, said sacrificial production increment including lost production of the continuous products;

control means for generating said control signals in response to a plurality of setpoint signals representing processing variables;

means for generating a product change request signal; and means for generating said setpoint signals, said signal generating means being responsive to said advance defining means and said product change request signal for changing the value of at least one of said setpoint signals associated with each of said first and second processing stations during the times that said sacrificial production increment is being processed by said first and second processing stations respectively.

2. A system according to claim 1 wherein said advance defining means includes means for marking said sacrificial production increment and means adjacent said first and second processing stations for detecting said marking and generating first and second detection signals respectively to said setpoint signal generating means in response to said detection.

3. A system according to claim 1 wherein said advance defining means includes means for generating a signal directly proportional to the speed of said sacrificial production increment through said first and second processing stations to said setpoint signal generating means.

4. A system according to claim 1 wherein said setpoint signal generating means changes the value of said at least one setpoint signal associated with each of said first and second processing stations in increments.

5. A system according to claim 4 wherein said increments are equal to the difference between a new value representing the one of the plurality of continuous products corresponding to said product change request signal and said value for said at least one setpoint signal multiplied by a predetermined rate of change for said at least one setpoint signal.

6. A system according to claim 1 wherein said setpoint signal generating means is a programmed digital computer.

7. A system according to claim 1 wherein said sacrificial production increment includes a void in the continuous products.

8. A method for changing the fibrous product manufactured by a continuous manufacturing process, comprising the steps of:

generating first and second setpoint signals for product variables of a first fibrous product being manufactured, said product variables defined by processing parameters of first and second spaced apart processing means respectively, said first and second processing means being responsive to said first and second setpoint signals respectively for processing said first fibrous product;

incrementally changing the value of said first setpoint signal to a value for a second fibrous product wherein said change defines a sacrificial production increment between the end of said first fibrous product and the beginning of said second fibrous product; and incrementally changing the value of said second setpoint signal to a value for said second fibrous product during the time said sacrificial production increment is being processed by said second processing means whereby the amount of lost production time and the amount of fibrous product sacrificed are minimized.

9. A method according to claim 8 wherein the steps of incremently changing the values of said first and second setpoint signals are repetitively performed at a preset rate selected to minimize the time required for the change.

10. A method according to claim 8 including the step of detecting the advance of said sacrificial production through said second processing station and initiating said step of incremently changing the value of said second setpoint signal in response to said detection.

* * * * *